United States Patent [19]

Mosler

[11] Patent Number: 4,779,584

[45] Date of Patent: Oct. 25, 1988

[54] INTERNAL COMBUSTION ENGINE INTAKE VALVE

[75] Inventor: Warren B. Mosler, Hobe Sound, Fla.

[73] Assignee: Warr Valves, Inc., Boca Raton, Fla.

[21] Appl. No.: 17,851

[22] Filed: Feb. 24, 1987

[51] Int. Cl.[4] ..... F01L 3/06; F01L 3/20

[52] U.S. Cl. ..... 123/188 A; 123/188 AA

[58] Field of Search ..... 123/188 A, 188 AA, 193 P, 123/264

[56] References Cited

U.S. PATENT DOCUMENTS

| | | | |
|---|---|---|---|
| 2,090,800 | 8/1937 | MacDonald | 123/188 A X |
| 3,626,815 | 12/1971 | Fingeroot et al. | 92/210 |
| 4,475,494 | 10/1984 | Huther | 123/188 A |

FOREIGN PATENT DOCUMENTS

| | | | |
|---|---|---|---|
| 284234 | 4/1931 | Italy | 123/188 A |
| 206238 | 11/1923 | United Kingdom | 123/188 A |
| 2115486A | 9/1983 | United Kingdom | 123/188 AA |

*Primary Examiner*—Samuel Scott
*Assistant Examiner*—Allen J. Flanigan
*Attorney, Agent, or Firm*—Harry W. Barron

[57] ABSTRACT

An improved intake valve for an internal combustion engine is provided. The improved valve has a ridge extending from the downstream side of the periphery of the valve head to aid in the improved aerodynamic flow of the fuel mixture gas through the valve opening. The ridge acts as the center portion of an ideal air foil and thus reduces the back pressure, and hence the drag, presented by the valve to the flowing gas fuel mixture. By reducing the drag, more fuel mixture in a given time and space can be provided into the combustion chamber and the horsepower of a given size engine is increased. In other words, a smaller and lighter engine can be used to do the same work, with the net result of better fuel economy, better packaging, lower production costs and so forth. Alternatively, a given sized engine can be made to produce more power. The size of the ridge is selected to be between five and twenty five percent of the valve head diameter and a thickness of the ridge wall is selected to be as narrow as possible consistent with long term performance. The ridge on the bottom of the valve head also flows less efficiently in the reverse direction, thereby allowing more desirable valve timing and cycle overlaps.

18 Claims, 1 Drawing Sheet

INTERNAL COMBUSTION ENGINE INTAKE VALVE

This invention related to an intake valve for an internal combustion engine and more particularly to such a valve having the valve head side, which is positioned wholly within the combustion chamber, shaped to reduce the coefficient of drag of the gaseous fuel mixture flowing around the valve and into the combustion chamber.

Internal combustion engines, such as gasoline engines, have been known for many years. Basically, such engines operate by injecting a fuel mixture into a combustion chamber through one or more intake valves, which are moved away from a seated position against the engine block at the part thereof defining the combustion chamber. The fuel mixture is then compressed and ignited and burns, causing a piston, having a drive rod connected to a drive shaft, to move within the chamber. Also associated with the chamber is one or more exhaust valves for allowing the exhaust fumes to exit the combustion chamber.

A typical intake valve design includes a valve stem and a valve head. The stem is juxtaposed with a rocker arm, or other cam actuated device, to allow movement into and away from the combustion chamber. The valve is normally spring biased in a direction away from the chamber and moved into the chamber (opened) by the cam actuated device and moved away from the chamber (closed) by the spring force. The valve head is typically shaped as a generally flat circle to blend with the surface of the combustion chamber on the downstream side thereof, remote from the valve stem, and tapered inward from the periphery of the circle towards the stem on the upstream side, that is the side of the valve head coupled to the stem. The upstream side of the valve and the opening into the combustion chamber are designed to have the same shape at some portion so as to provide a sealed seat effect between the valve and the chamber wall when the valve is closed. Thus, fuel can only enter the chamber when the valve is opened, or moved forward into the chamber, to break the seal formed by the seat.

The amount of horsepower delivered by the engine is determined by, among other things, the amount of fuel mixture entering the combustion chamber. As the intake valve is moved into the chamber, the fuel mixture enters the combustion chamber around the intake valve in the space between the valve and the block. However, a totally free flow of the fuel mixture is prevented due to the drag created as the gaseous fuel mixture travels around the valve head, thus, limiting the maximum amount of horsepower that can not be obtained for a given sized set of engine components. To increase the horsepower, a larger engine must be used and the fuel economy decreases due to the extra weight required. On the other hand, if the valve could be designed to allow a more efficient flow of the fuel mixture, smaller engines could be used to obtain a given amount of horsepower, and hence the vehicle would weigh less and the fuel economy would be better. In other situations, such as race cars where rules limit the size of engine components, additional horsepower, and hence speed, can be obtained by using a valve which allows additional fuel mixture to flow into the combustion chamber as a result of better fuel efficiency.

Many attempts have been made to effect the fuel entering the combustion chamber. For example, in U.S. Pat. No. 3,881,459 to Gaetcke, two concentric valves are utilized to allow the fuel mixture entering the combustion chamber to more evenly fill the provided space. In U.S. Pat. No. 3,757,757 to Bastenhof, a specially designed deflector plate on the valve stem side of the valve head is provided to initiate a turbulence in the fuel mixture to cause a better mixture of the air and fuel. Others have tried to accomplish a similar function by creating a swirling movement of the fuel in the fuel line connected to the combustion chamber. Others have tried various forms of valve modifications for solving particular problems, such as providing fins on the valve head to cause the valve to rotate. For example, see U.S. Pat Nos. 3,090,370 to Kimball, 2,403,001 to Jacobi, 1,750,995 to Edwards, 1,523,965 to Howell and 1,522,760 to Rothenbucher.

None of the prior attempts at valve design modification have taken into account any drag created by the downstream valve design in the attempt to allow more of the fuel mixture to enter the combustion chamber. Obtaining more fuel mixture in the combustion chamber has historically been accomplished by either increasing the diameter of the valve, by using a plurality of valves, or by modifying the upstream side of the valve head.

In accordance with one aspect of this invention, there is provided an inlet valve for an internal combustion engine for allowing a fuel mixture to enter the combustion chamber. The valve comprises a stem and a head. One side of the head is positionable within said chamber and the other side of the head is attached to the stem and is movable from a seated position with the chamber to allow the fuel mixture to enter the chamber. The one side of the head in the chamber has an extension along the periphery thereof and in a direction away from the stem.

A preferred embodiment of the subject invention is hereafter described with specific reference being made to the following Figures, in which.

Figure 1:
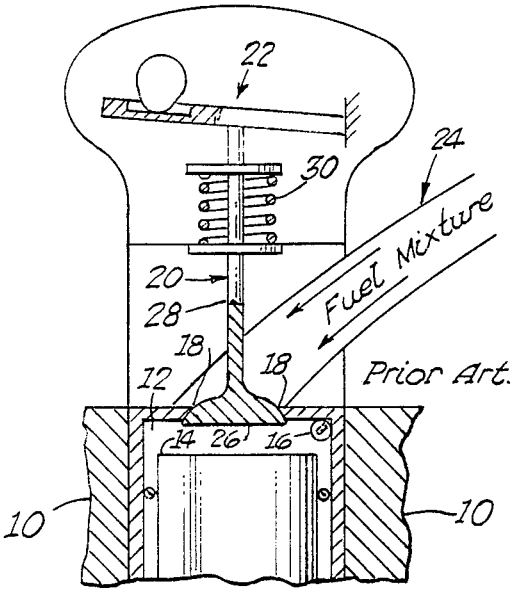
FIG. 1 is a diagram, partially schematic, showing the operation of an intake valve as used in an internal combustion engine according to the teachings of the prior art.

Referring now to FIG. 1, a schematic diagram of a typical prior art internal combustion engine is shown and includes a cylinder block 10 having a combustion chamber cylinder 12 containing a conventional piston 14. While not shown in FIG. 1, the bottom of piston 14 is connected to a drive rod which turns a drive shaft to deliver power as desired. For example, the drive shaft may be connected to turn the wheels of an automobile, or the blade of a power lawn mower. The manner in which piston 14 is caused to move is that a fuel and air mixture flows into chamber 12 through an entry port 18 and the mixture is compressed and then ignited by, for example, a spark from spark plug 16. When the fuel mixture is ignited, the hot exploded gas, caused by the ignition, expands rapidly, thereby causing the piston 14 to move in a downward direction, as shown in FIG. 1. The moving piston, in turn turns the drive shaft in a known manner.

In order to prevent the hot gas from escaping through the entry port 18, an inlet valve 20 is provided to open entry port 18 during the time fuel mixture enters chamber 12 and to close entry port 18 during the compression, ignition and subsequent burning. Valve 20 is operated by being moved into the chamber 12 by rocker arm assembly 22 to allow fuel applied through fuel passage 24 to enter chamber 12 around the sides of the valve head 26 portion of valve 20. Valve head 26 is connected to a valve stem 28, which in turn, is moved towards chamber 12 by rocker arm assembly 22 and away from chamber 12 by the bias of spring 30. When valve 20 is moved towards chamber 12 by rocker arm assembly 22 moving downward from the position shown in FIG. 1, a fuel mixture flows through fuel passage 24 from either a fuel injector (not shown) or a carburetor (not shown) and through the opening between valve 20 and cylinder block 10 at port 18. When rocker arm assembly 22 returns to the position shown in FIG. 1, spring 30 forces valve 20 to the position shown and a sealed seat is formed between the side of valve head 26 towards valve stem 28 and the block 10. This seat prevents any further fuel mixture from flowing into chamber 12.

The potential horsepower rating of an engine is largely dependent on the amount of the fuel mixture which passes through the port 18 into the chamber 12 when valve 20 is opened. Turbocharging, for example, is used to pressurize the intake passage in order to force more mixture past the valve 20. Since the amount of space available for the passage of fuel is limited, due to the short distance that valve 20 is allowed to travel in the time allowed between strokes of the engine, the amount of the fuel mixture which can pass around valve head 26 is correspondingly limited. It is desirable to increase the amount of fuel entering into chamber 12 through the open port 18 in order to increase the volumetric efficiency of the engine.

Figure 2A:
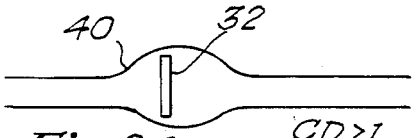
FIGS. 2A, 2B, 2C and 2D are diagrams showing the coefficient of drag (CD) for various shaped obstacles placed in the path of a flowing gas.
Figure 2B:
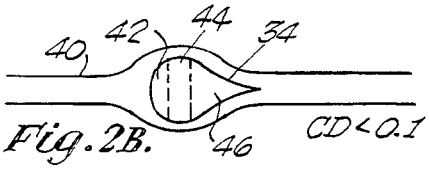

Referring now to FIGS. 2A, 2B, 2C and 2D, various shaped obstacles 32, 34, 36 and 38 are respectively shown as being placed in the path of a flowing gas 40. For each obstacle shape, a coefficient of drag (CD) can be determined which acts to retard the free flow of the gas 40. For example, in FIG. 2A, a thin plate 32 is placed in the path of flowing gas 40 and the coefficient of drag is greater than 1.0. This means that less gas will be present on the downstream side of plate 32 for a constant pressure in comparison to the amount of gas which would be present in the absence of any obstacle placed in the path of the flowing gas 40. FIG. 2B shows an ideal air foil shaped obstacle 34 placed in the path of the flowing gas 40. In this situation, the coefficient of drag is less than 0.1, whereby a significantly greater amount of flowing gas 40 will be on the downstream side of the ideal airfoil shape obstacle 34. Thus, to the extent possible, one should shape any obstacle in the path of a flowing gas 40 as an ideal air foil so that a greater amount of the gas 40 can pass around the obstacle, or in other words, so that the drag due to the gas 40 passing around the obstacle is reduced to a minimum.

To replace valve 20 in FIG. 1 with an ideal air foil would be impossible for several reasons. First, the upstream side of the valve head 26 requires the valve stem 28 to be connected thereto and other refinements, such as fins for rotating the valve 20, are desirably incorporated in the design of the upstream side of valve head 26. However, the downstream side of valve head 28, that is that portion of valve 28 positioned wholly within the chamber 12, may be modified to provide less drag to the flowing gaseous fuel mixture. However, to incorporate an entire ideal air foil shaped back end to the downstream side of valve head 28 has two disadvantages. First, the mass of the valve head 28 will be greatly increased, thereby making the fast opening and closing thereof more difficult. Second, the amount of space required to accommodate the downstream side of the ideal air foil in the combustion chamber is not typically available. In some engine designs, as will be explained in FIG. 5, a cutout in the top of the piston can be made to provide room for extending the valve further into combustion chamber 12, but in other engine designs, the valve is positioned at an angle with respect to the piston movement and the combustion chamber 12 wall is in the way.

Figure 2C:
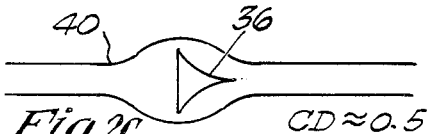
Figure 2D:
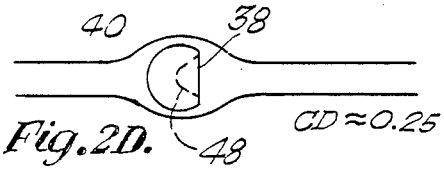

Referring again to FIG. 2B, the ideal air foil obstruction 34 may be divided into three separate portions, referred to as the front portion 42, the middle portion 44 and the rear portion 46. Each of the portions 42, 44 and 46 perform generally the same function of allowing the air to be turned around the obstacle 34 in a continuous and even manner and to ultimately return to its original path. Referring to FIG. 2C, if one were to take only rear portion 46 of the ideal air foil and insert it into the path of a flowing gas 40, the coefficient of drag would be reduced approximately in half when compared to placing a flat plate in the path of the flowing gas 40, such as was the case in FIG. 2A. If only the front portion were placed in the path of flowing gas 40, a reduction of approximately 65% would occur and if only the middle portion 44 were placed in the path of flowing gas 40, a reduction of approximately 25% would occur. Referring to FIG. 2D, however, if one were to take both the front and middle portions 42 and 44 of ideal air foil 34 and place them in the path of the flowing gas 40, the coefficient of drag would be reduced to approximately one fourth of that obtained when the plate 32 is placed in the path of the flowing gas 40, as seen in FIG. 2A. The exact amount of the reduction of the coefficient of drag will depend primarily upon two factors, which are the length of the obstacle 38 and the curvatures of the sides thereof.

When applying the principal of FIG. 2D to an engine intake valve, it is desirable to minimize the extension length due to the extra weight included in the valve. However, much of the extra weight can be reduced by eliminating the center portion of the obstacle 38, such as shown by the dashed lines 48 in FIG. 2D. Further, while the outer sides of obstacle 38 should ideally be curved, it has been found that making them straight still significantly reduces the coefficient of drag of the flowing gas 40, particularly where the length is limited.

In the past, valve designers have appreciated the benefit of curving the upstream side of the valve head 26 to reduce the coefficient of drag. However, heretofore, no one has made any attempt to design the downstream side of the valve head 26 to take into effect the reduction in drag and corresponding increase in fuel mixture which can enter the combustion chamber 12. On the contrary, valve designers have typically shaped the downstream side of the valve head 26 to conform to the inside shape of the combustion chamber and to limit the protrusion within the interior of the combustion chamber 12 as much as possible. One reason for limiting the protrusion is because the piston 14 typically is moved to within 0.015 inches of the bottom of valve head 26 and if valve head 26 extends too far into combustion chamber 12, either a portion of the top of piston 14 must be removed or the piston stroke must be reduced in order to provide sufficient clearance.

Figure 3:
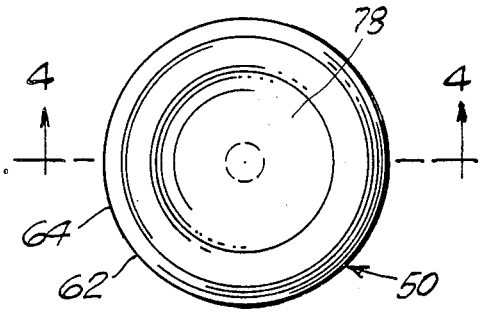
FIG. 3 is a bottom view of the improved intake valve of the subject invention.
Figure 4:
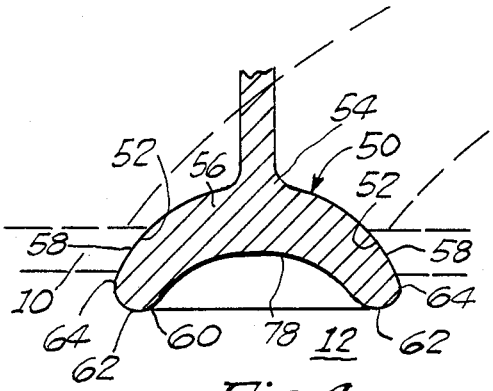
FIG. 4 is a cut-away side view of the improved intake valve of the subject invention.

Referring now to FIGS. 3 and 4, one embodiment of an improved intake valve 50 according to the subject invention is shown. In FIG. 3, a bottom view, as seen from inside chamber 12 of FIG. 1, of the improved valve 50 is shown and in FIG. 4, a cross sectional view across lined 4—4 of FIG. 3 is shown. In FIG. 4, the engine block 10 is shown in dashed lines relative to valve 50 being in the closed position. In other words, a portion 52 of the upstream side 54 of valve head 56 rests firmly against a similarly reversed shaped portion 58 of block 10 to form a seated seal to prevent the fuel mixture from entering and the exploded gas from leaving the combustion chamber 12. When valve 50 is moved downward by, for example, the action of rocker arm assembly 22 shown in FIG. 1, a space is provided between valve 50 and block 10 through which the fuel mixture flows. The fuel mixture is in the form of a gas and hence the principals from FIG. 2D can be applied to the downstream side 60 of valve head 56. To do this, a circular ridge 62 is provided from the periphery 64 of the downstream side 60 of valve head 56.

The extension (or height, when viewed upside down) of annular ridge 62 below the valve seat surface 52 should be chosen to be between five and twenty five percent of the diameter of valve head 56 in order to take best advantage of the principal explained with respect to FIG. 2D. The exact amount of the extension will depend upon the diameter of valve and the configuration of the combustion chamber 12 and the cylinder head. As a general rule, an extension of approximately ten percent of valve head should be sufficient to provide a majority of the obtainable increase in amount of fuel mixture passing around valve 50 when it is in the open position.

The side of ridge 62 extending from the periphery 64 of valve head 56 may be shaped in a curve towards the center of valve 50 for the best performance. However, where the extension of ridge 62 is relatively small, such as less than fifteen percent of the valve head 56 diameter, a larger radius, or even a straight edge, will operate with adequate performance improvement. The size of valve 50 should always be minimized to avoid excessive weight as a trade-off with increased flow. Hence, area 78 may be hollowed out and concave.

In one specific example, a valve 50 having a valve head 56 diameter of two inches was built with a ridge 62 one fourth of an inch in length and three eighths of an inch in thickness. The outer edges of ridge 62 are curved with a compound radius averaging approximately one foruth of an inch and bench tests were performed to determine the amount of additional fuel which could enter the combustion chamber 12. It was found that there was a 23 percent increase in the amount of the fuel mixture could enter into the combustion chamber 12 with a valve opening (lift) of 0.100 inches. This increase in fuel mixture entering the combustion chamber 12 directly leads to a corresponding increase of horsepower provided by the engine.

Figure 5:
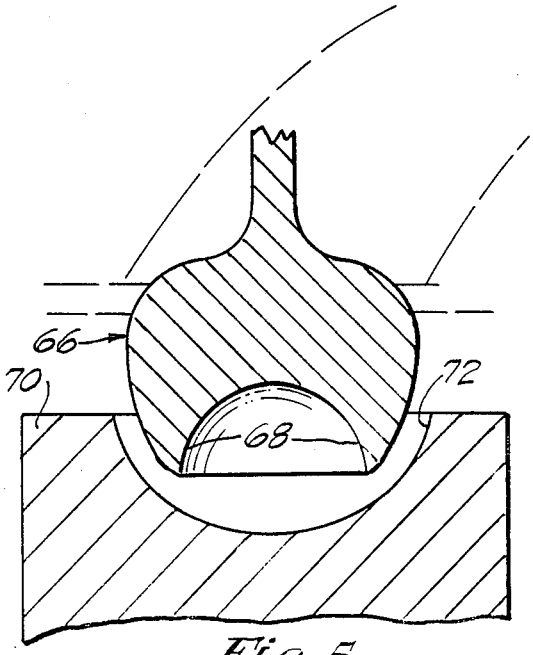
FIG. 5 is a cut-away side view of another embodiment of the improved intake valve of the subject invention.

Referring now to FIG. 5, an alternate embodiment of the improved intake valve 66 is shown. For valve 66, the extension (or height, when viewed upside down) of annular ridge 68 below the valve seat 52 is increased and a curve similar to the ideal air foil is provided on the peripheral edge of the ridge 68. Because of the increased extension of ridge 68, insufficient room is available for piston 70 to complete its return stroke and valve 66 to be opened. In order to allow piston 70 to move properly, a cutout 72 from the top thereof is made so as not to cause any interference with the bottom of ridge 68 when piston 70 is in the up position, as seen in FIG. 5, and valve 66 is opened by being moved downward. By making the extension of ridge 68 longer and shaping it as an ideal air foil, a still greater amount of fuel mixture can flow into chamber 12 with the FIG. 5 embodiment. This type of shape may be particularly useful for smaller diameter valves. Cutout 72 may be merely a ring taken from the top of piston 70 rather than the an entire volume as shown in FIG. 5. It should be noted that such a cutout 72 may be required even with a small ridge, such as ridge 62 shown in FIG. 4, based on the available space.

Another advantage of providing the ridge 62 or 68 on the downstream side of valve head 56 or valve 66 is that this configuration restricts the flow of gases in the reverse direction. Such a restriction proves useful in using the optimum valve timing and overlaps of the various phases of engine cycles, further increasing efficiency.

What is claimed is:

1. An inlet valve for an internal combustion engine for allowing a fuel mixture to enter the combustion chamber, said valve comprising:

a stem; and a head having a seat portion adapted to seal with a corresponding surface of an intake port in said combustion chamber, and further having one side positionable within said chamber and the other side attached to said stem, said head being movably from a seated position into said chamber to allow said fuel mixture to enter said chamber, said one side commencing from and beyond the chamber facing seat edge when said valve is seated, and said one side having an annular ridge located along the periphery thereof and in protrusion g in a direction away from said stem, the outer peripheral surface of said ridge and said seat portion forming a continuous smooth surface.

2. The invention according to claim 1 wherein said ridge is of sufficient length to reduce the coefficient of drag of said mixture entering said chamber around said head.

3. The invention according to claim 2 wherein said outer surface of said ridge is shaped as one side of an airfoil.

4. The invention according to claim 1 wherein said outer surface of said ridge is shaped as one side of an airfoil.

5. The invention according to claim 1:

wherein said head is circular; and wherein said ridge has a certain extension distance and a certain width, said width being less than one half of the diameter of said head.

6. The invention according to claim 5 wherein said certain extension distance is between five percent and twenty five percent of said diameter.

7. The invention according to claim 6 wherein said certain extension distance is approximately ten percent of said diameter.

8. The invention according to claim 5 wherein said head is circular in shape and said certain width is less than one half of the diameter of the circular shape of said head.

9. The invention according to claim 8 wherein said certain length is between five percent and twenty five percent of said diameter.

10. In a inlet valve for use in an internal combustion engine in which said valve has a stem and a head, said head having, when seated, a first side positioned within a combustion chamber of an engine block and a second, opposite, side attached to said stem, said second side including that portion of said head forming the seat with said engine block when said valve is in a seated position, said first side including that portion of said head from said seat toward said chamber when said valve is in said seated position, and said engine including means for moving said valve from said closed position to an open position to allow a fuel mixture to enter said chamber, the improvement in said valve comprising:

an extension ridge from said first side, positioned in alignment with the periphery of said valve head, said ridge forming with said seat a single, continuous, smooth outer surface along said periphery thereof for reducing the coefficient of drag of the fuel entering said chamber around said valve head when said valve is in said open position.

11. The invention according to claim 10 wherein said valve head is circular in shape with a given diameter and said extension is of a certain length and a certain width, said certain width being less than one half of said diameter.

12. The invention according to claim 11 wherein said certain length is between five and twenty five percent of said diameter.

13. The invention according to claim 12 wherein the side of said extension aligned with said periphery is curved.

14. The invention according to claim 12 wherein said curved side of said extension is shaped as a portion of an airfoil.

15. The invention according to claim 14 wherein said portion of said airfoil includes the thickest portion thereof.

16. The invention according to claim 10 wherein the side of said extension aligned with said periphery is curved.

17. The invention according to claim 10 wherein said curved side of said extension is shaped as a portion of an airfoil.

18. The invention according to claim 17 wherein said portion of said airfoil includes the thickest portion thereof.

* * * * *

UNITED STATES PATENT AND TRADEMARK OFFICE

CERTIFICATE OF CORRECTION

PATENT NO. : 4,779,584

DATED : October 25, 1988

INVENTOR(S) : Warren B. Mosler

It is certified that error appears in the above—identified patent and that said Letters Patent is hereby corrected as shown below:

Delete Claims 8,9, 13 and 16 .

On the Title Page, "18 Claims, 1 Drawing Sheet" should read

-- 14 Claims, 1 Drawing Sheet --.

Signed and Sealed this

Twelfth Day of September, 1989

*Attest:*

DONALD J. QUIGG

*Attesting Officer*

*Commissioner of Patents and Trademarks*